United States Patent [19]

Terry et al.

[11] 4,019,578

[45] Apr. 26, 1977

[54] RECOVERY OF PETROLEUM FROM TAR AND HEAVY OIL SANDS

[76] Inventors: Ruel C. Terry, 3090 S. High St., Denver, Colo. 80210; Xerxes T. Stoddard, 4617 W. 27th Ave., Denver, Colo. 80212

[22] Filed: Mar. 29, 1976

[21] Appl. No.: 671,259

[52] U.S. Cl. ..... 166/267; 166/271; 166/272

[51] Int. Cl.[2] ..... E21B 43/24; E21B 43/26

[58] Field of Search ..... 166/267, 271, 272, 275, 166/302, 303; 299/4

[56] References Cited

UNITED STATES PATENTS

| | | | |
|---|---|---|---|
| 2,991,987 | 7/1961 | Heinze | 166/303 X |
| 3,221,813 | 12/1965 | Closmann et al. | 166/271 |
| 3,372,750 | 3/1968 | Satter et al. | 166/272 |
| 3,379,247 | 4/1968 | Santourian | 166/272 |
| 3,385,359 | 5/1968 | Offeringa | 166/272 X |
| 3,421,583 | 1/1969 | Koons | 166/272 X |
| 3,439,742 | 4/1969 | Durie | 166/272 |
| 3,692,111 | 9/1972 | Breithaupt et al. | 166/272 X |

*Primary Examiner*—Stephen J. Novosad
*Assistant Examiner*—George A. Suchfield
*Attorney, Agent, or Firm*—Ruel C. Terry

[57] ABSTRACT

This invention relates to the recovery of petroleum from tar and heavy oil sands in which one or more injection passages and two or more removal passages are established between the surface of the ground and an underground petroleum deposit. Hot water is injected into the petroleum deposit at a temperature above the pour point temperature of the petroleum substance, and heat is transferred until the petroleum substance becomes flowable. Under the influence of induced pressure, the petroleum substance is made to flow countercurrent to the flow of heat, with the petroleum substance captured at the surface of the ground.

8 Claims, 2 Drawing Figures

RECOVERY OF PETROLEUM FROM TAR AND HEAVY OIL SANDS

REFERENCES

U.S. Pat. Nos.: 3,180,414, 3,221,813, 3,289,763, 3,324,946, 3,333,637, 3,379,247, 3,465,826, 3,468,826, 3,815,678.

BACKGROUND OF INVENTION

In the conventional petroleum industry it is well known in the art how to find hidden underground reservoirs, how to drill and complete wells in the petroleum reservoir, and how to withdraw petroleum products to economic depletion and the like. In conventional petroleum reservoirs the petroleum itself is quite mobile and often will flow to the surface once a well is drilled into the reservoir. The reservoir exists because petroleum migrated into the permeability and porosity of the host rock (usually of sedimentary origin) and was trapped in place by a fault, permeability pinchout and the like. The petroleum under these circumstances is flowable and will move under the influence of differential pressure. Such a petroleum would contain an array of hydrocarbons, varying from those that would be gases at atmospheric pressure to those that would be quite viscous were they not mixed with lighter constituents.

A special case of petroleum reservoirs are those commonly called heavy oils, bituminous deposits and tar sands. These are more properly termed deposits because the petroleum values cannot be recovered by conventional oil field techniques. These deposits are for all practical purposes composed of petroleum hydrocarbons that are immobile. Immobility is occasioned by the fact that all or virtually all of the lighter fractions of conventional petroleum crude are missing, leaving a residue of viscous heavy hydrocarbons. In some case these heavy hydrocarbons have the appearance of hard solid substances that fill the void space in the host rock in somewhat the same manner as grout. In other cases these heavy hydrocarbons have the appearance of a sticky semi-solid that has adhesive qualities somewhat like that of glue. In either case it is virtually impossible and certainly impractical to attempt to dislodge the heavy hydrocarbons by applying differential pressure.

All of the petroleum hydrocarbons in these heavy hydrocarbon deposits have one thing in common. Upon application of heat the heavy hydrocarbon mixture becomes semi-liquid, then liquid, then free flowing liquid. It is not uncommon to find a heavy hydrocarbon mixture that at a temperature of 200° F has the flow characteristics similar to a conventional quality petroleum crude at room temperature. Fortunately most heavy oil crudes attain acceptable fluidity at temperatures well below ignition temperatures so there is no danger of the crude flashing to fire upon being exposed to air.

The problem of production of heavy oil crudes, as is well known in the art, is how to bring the massive deposit up to flowable temperature so that it can be produced as a petroleum reservoir. The problem is further complicated by the fact that it is quite common to find the deposit being composed of a series of lenticular segments, which probably are interconnected. Generally these interconnecting passages between the lenticular segments are so small compared to the individual segment that it is very difficult to transfer heat from one segment to the next. Thus each segment tends to be a deposit or reservoir to itself.

There have been numerous schemes advanced for the addition of heat to tar sands and similar deposits, from underground nuclear explosions to setting the deposit afire in the manner of conventional petroleum fire floods. Other schemes have fostered the idea of heating the deposit by heat transfer from circulating fluids. All schemes tried have had a measure of technical success, but have failed as commercial ventures as a general rule. One notable success is a project in the Athabaska tar sands of Canada wherein heat is not applied to the deposit, but rather the deposit is grubbed up and transported to an above ground processing plant.

There are numerous reasons why methods of the prior art have been failures in the commercial sense in trying to add heat to the deposit. First, the heavy hydrocarbons themselves are poor conductors of heat, thus the scheme to use heated hydrocarbons to transfer heat to cooler hydrocarbons is a slow process with heat losses to surrounding host rock tending to negate the positive effects. The host rock is also a poor conductor of heat which thwarts efforts to speed up heat transfer to the heavy hydrocarbons, and further serves as a heat sink to diminish the efficiency of applying heat for a useful purpose. The host rock filled with grout-like heavy hydrocarbons has a very low effective permeability to permit the invasion of hot gases or vapors such as steam. This low effective permeability prohibits the use of heat and pressure to drive the heavy hydrocarbons to an adjacent production well because the heavy hydrocarbons mobilized by the heat will be driven by pressure into the available permeability, become cooled and immobile away from the influence of the heat, and thus effectively plug all the remaining permeability.

Thus it is apparent that removal of mobilized heavy hydrocarbons should be in the direction of the oncoming heat, which is to say that the residual mobilized petroleum must move generally countercurrent to the flow of heat. Once this mechanism is established the flow of petroleum will be facilitated by becoming warmer and less viscous. Further, by withdrawing petroleum from its previously locked position, effective permeability is significantly increased through the host rock, permitting the application of heat from the carrier fluid directly to exposed residual heavy oil crude to be heated, mobilized, withdrawn, and so on.

It is an object of the present invention to disclose new methods of mobilizing viscous residual hydrocarbons by the application of heat by means of a carrier fluid, withdrawing the mobilized heavy hydrocarbons to an underground location and conveying the hydrocarbons to the surface of the ground. Other objects, advantages, and capabilities of the present invention will become apparent as the discription proceeds and in conjunction with the accompanying drawings.

SUMMARY OF THE INVENTION

Figure 1:
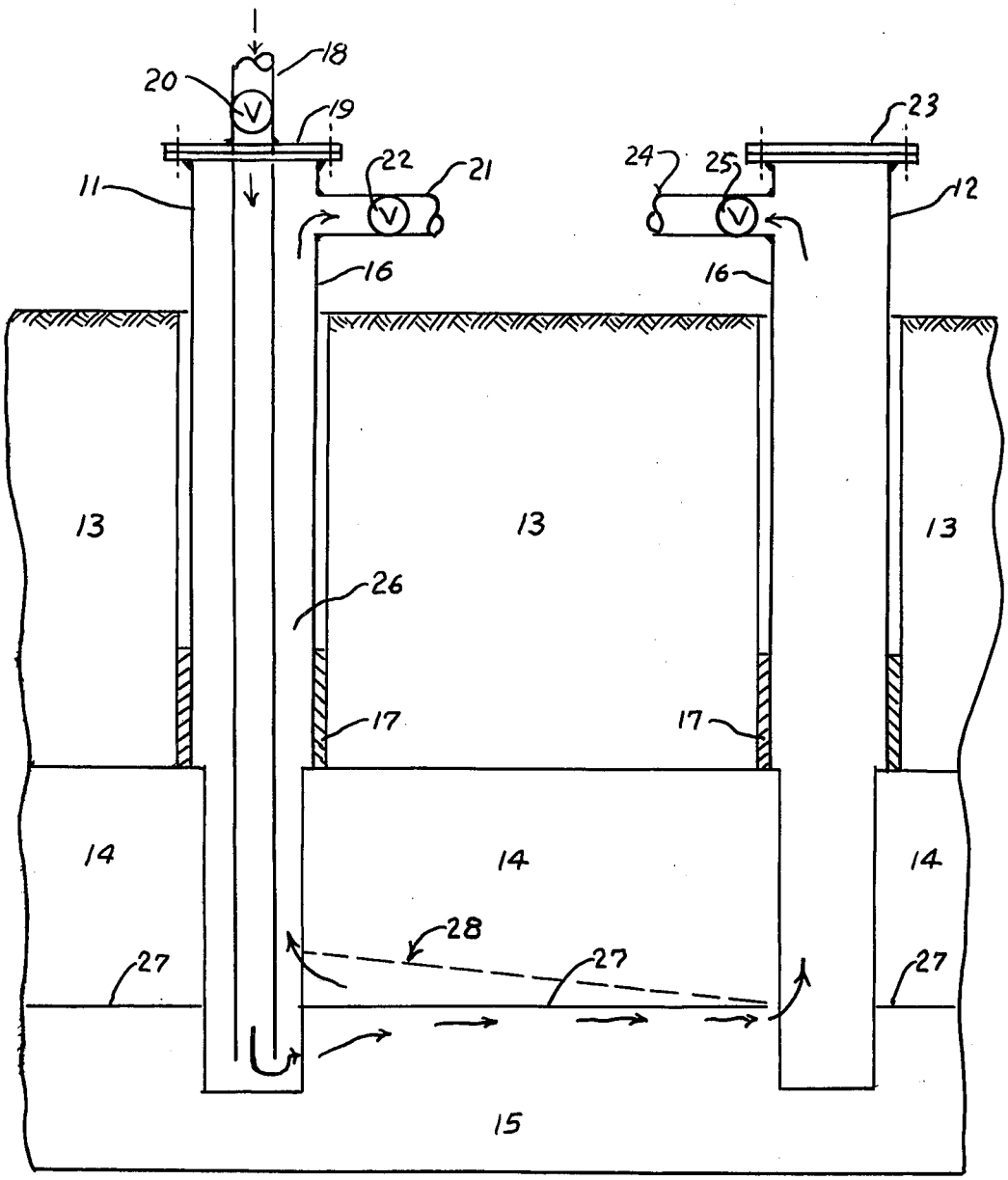
FIG. 1 is a diagrammatic vertical cross section taken through a portion of the earth showing a pair of wells, the overburden, the heavy oil or tar sands stratum, and the water bearing sands stratum.
Figure 2:
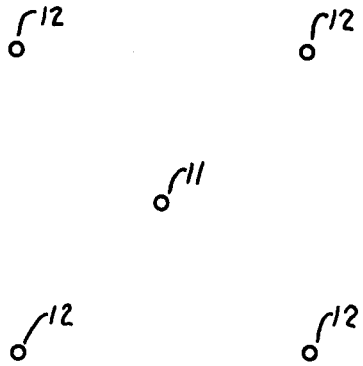
FIG. 2 is a plan view of a possible well pattern.

No particular novelty is claimed in the use of heat to mobilize an immobile hydrocarbon such as heavy oil crude or the bitumen in tar sands. No particular novelty is claimed for establishing reservoir pressure by injecting fluids into the reservoir.

In commercial practice of the present invention a mulitplicity of wells would be drilled into the stratum to be produced, but for illustrative purposes only, two wells are shown. As illustrated, two wells are drilled from the surface of the earth to the top of the petroleum bearing stratum. Each well is equipped with casing which is cemented in place to provide a hermatic seal. The wells are then deepened through the petroleum bearing stratum, sometimes called the pay zone, and into the underlying water bearing stratum or aquifer. As illustrated, the pay zone host rock is assumed to be competent to the extent it will give up fluids without crumbling into the open hole. Similarly the host rock of the water bearing stratum is assumed to be competent to the extent of permitting fluids to move through it without caving or slumping. Should either of the host rock strata tend to crumble, a protective liner with perforations opposite the two strata could be set in the well bore.

The pay zone at ambient temperature is virtually impervious to the passage of fluids. The underlying aquifer is a carrier of fluids and thus permits the free movement of fluids through it. Since it is necessary to establish fluid communication underground between the two wells, the situation as illustrated is ideal for the practice of the present invention. Should a permeable medium such as the water bearing stratum not be present underneath the pay zone, communication between the wells can be established by fracturing techniques commonly employed in the petroleum industry.

By way of example the overburden is described as being 250 feet thick, the pay zone is 50 feet thick, and the wells are bottomed five feet into the water bearing stratum. The pay zone is impregnated with heavy oil or bitumen with an API gravity of approximately 10, or approximately the same specific gravity as water. The host rock of the pay zone and of the aquifer is porous sandstone. The boundary between the pay zone and the aquifer is the oil-water contact.

For a cold water test it is easy to envision that by injecting water into one well at a pressure significantly above the hydrostatic head pressure, water can be made to flow to the surface of the ground via the second well. In this mode of circulation, the heavy oil or bitumen will remain locked in place.

It is well known in the art that fluid crude petroleum preferentially wets the host rock in comparison to natural gas of petroleum origin, and that water preferentially wets the host rock in comparison to fluid crude petroleum. In the case as illustrated only an insignificant amount of connate water is dispersed through the pay zone, and the zone has no effective permeability since the pore space and its interconnections is plugged with the immobile heavy oil crude.

For illustrative purposes the heavy oil crude or bitumen is described as having a pour point temperature of 100° F and the pay zone temperature is 60° F. Thus the heavy oil crude is, in effect, frozen in place and the reservoir pressure in the pay zone is static.

Referring to FIG. 1, two wells 11 and 12 are drilled from the surface of earth through the overburden 13 to the top of the pay zone 14. A casing 16 is set and cemented 17 into place. The amount of cement used should be enough to assure a hermatic seal between the pay zone and the surface of the earth. Well diameter could be for example nine inches and the casing diameter could be for example seven inches. The wells are then deepened by drilling through pay zone 14 and into water bearing stratum 15 so that the wells penetrate for example the top five feet of the water bearing stratum. Tubing 18 with a diameter of for example two and seven-eighths inches is set within well 11 with the bottom of the tubing located for example three feet from the bottom of the hole. Tubing 18 contains valve 20 and is suspended by wellhead 19. Wellhead 19 also contains flow line 21 which contains valve 22. Well 12 is fitted with wellhead 23 which contains flow line 24 which in turn contains valve 25. The complete system is hermatically sealed.

In this arrangement fluids can be made to flow under the influence of differential pressure through tubing 18, annulus 26, flow line 21, casing 16 of well 11, flow line 24 and water bearing stratum 15.

Description of the Preferred Embodiment

The process begins by opening valve 20 and injecting hot water at a temperature of for example 330° F under pressure for example of 175 psi into tubing 18 at a rate for example of 300 gallons per minute. Valves 22 and 25 are opened to the extent necessary to permit expulsion of air or other fluids as the circulating system pressure builds up. As soon as water begins to flow out of flow line 21, valve 22 is closed and valve 25 is opened fully.

The water being injected in stratum 15 through tubing 18 begins to displace water in the aquifer, and due to differential pressure the water column in well 12 will rise until flow is established through flow line 24. Initially the temperature of the water exiting through flow line 24 will be substantially the temperature of the water in stratum 15, for example 60° F. As circulation continues the temperature of the water exiting through flow line 24 will gradually increase, and due to heat losses in the circuit will stabilize at a temperature for example of 150° F.

The water entering stratum 15 is substantially hotter than the water within the stratum, thus is less dense, and by comparison more buoyant. Therefore the injected water will tend to override the cooler water in stratum 15, and will tend to circulate near the oil-water contact 27.

The circulating hot water at or near the oil-water contact 27 will lose heat to the cooler overlying pay zone 14. The heavy oil nearest the circulating water will increase in temperature from for example 60° F to its pour point temperature for example 100° F in a relatively short time, and traces of oil will begin to show in the water exiting through flow line 24. With continuing circulation the temperature of the lower section of pay zone 14 will rise to the point that its heavy oil content will become quite flowable. This condition will be signaled at the surface of the ground by increasing shows of oil in the water exiting through flow line 24.

Witb continued circulation of hot water a portion of the lower section of pay zone 14 will be heated to a temperature at or above the pour point temperature of the entrapped heavy oil crude, for example a temperature of 100° F or above. This heated portion of pay zone 14 is indicated on FIG. 1 as the material between oil-water contact 27 and the dotted line 28. The heavy oil crude in the described lower portion of pay zone 14 is now at or above its pour point temperature and is in flowable condition. The heated heavy oil crude, although of similar specific gravity as the injection water, is of different physical characteristics compared to the water, and the heavy oil crude will coalesce into a multiplicity of droplets of varying sizes. These droplets of heavy oil crude have a bulk density somewhat less than a corresponding volume of water and are more buoyant. In this mode the droplets of heavy oil crude will migrate to the highest permeable point in the fluid column. While the exact mechanism of the movement of heavy oil crude droplets is not well known in the prior art, it is believed that buoyancy is attained by a combination of differential density and surface tensions.

With mobility attained in the heavy oil crude by continuing addition of heat, the droplets will migrate in part toward well 12 in the sweep of circulating water, but more particularly upward in the annulus 26 of well 11 under the influence of buoyancy. THe droplets ascending in annulus 26 will displace the hot water in annulus 26 to a substantial degree and will tend to agglomerate in the uppermost portion of annulus 26. The uppermost portion of annulus 26 also tends to be the hottest location for the accumulation of heavy oil crude due to the transfer of heat from the hot injection fluid through the wall of tubing 18.

The hot heavy oil crude may now be recovered through flow line 21 by opening valve 22 where the existing fluids are composed for example of 95% hot heavy oil crude and 5% water. Temperature of the fluids exiting through flow line 21 can be for example 200° F or higher. A portion of the heavy oil crude may be recovered through flow line 24 where the exiting fluids are composed for example of 95% water and 5% heavy oil crude at a temperature for example of 150° F.

The exiting fluids from flow lines 21 and 24 are directed to above ground facilities (not shown) where the hot heavy oil crude is separated from the water using methods common in the petroleum industry. As a practical matter the separated crude oil is directed to storage tanks and then to market, while the separated water is saved for reheating and recycling through the hot water injection circuit.

By continuing the injection of hot water into the pay zone 14 the temperature boundary 28 will gradually ascend generally in parallel to line 28 as shown on FIG. 1. With the heavy oil crude removed from the lower portion of pay zone 14 by the mechanisms described above, a substantial amount of porosity and permeability of the host rock will be opened to the passage of fluids and the oil-water contact 27 also ascends generally parallel to ascending temperature boundary 28. In order to provide maximum heat transfer from the circulating hot water, tubing 18 is raised periodically so that the bottom of tubing 18 is near the ascending oil-water contact boundary 27.

As the process continues water will invade into the portion of pay zone 14 wherein the heavy oil crude has been mobilized and in part removed. While water preferencially wets the host rock compared to the heavy oil crude, the process of doing so can sometimes be too slow for commercial purposes. The thin film of oil adhering to the surfaces of the host rock can at times be a substantial percentage of the original oil in place. In the process of the present invention suitable additives commonly used in conventional petroleum water floods can be mixed with the injection water to break the film of oil adhering to the surfaces of the host rock, allowing a substantial amount of the residual oil to be produced.

Thus it may be seen that an immobile heavy oil crude can be mobilized by the methods of the present invention, that a substantial amount of the crude in place can be conditioned so that it will migrate toward the source of heat and thus be increasingly more flowable, and that substantial deposits of heavy oil crude and tar sands bitumen can be unlocked and recovered at the surface of the ground.

While the present invention has been described with a certain degree of particularity, it is understood that the present disclosure had been made by way of example and that changes in details of structure may be made without departing from the spirit thereof.

What is claimed is:

1. A method of mobilizing and producing normally immobile hydrocarbons from an underground location, comprising the steps of establishing a first passage between a surface location and a underground deposit of carbonaceous material that is capable of becoming liquid upon application of heat, said first passage containing a fluid injection and a fluid withdrawal means, establishing a second passage between a surface location and the said underground deposit, the second passage being spaced apart from the said first passage, establishing a subsurface communication third passage between the the first passage and the second passage, passing a fluid having a temperature above the pour point temperature of the said carbonaceous material through the said subsurface communication third passage between the first passage and the second passage, said fluid being under a pressure greater than the hydrostatic head pressure, thereby establishing a flow of heat from the injection means in the first passage through the subsurface communication third passage and through the second passage, transferring heat from the circulating fluid to the said carbonaceous material until the temperature of the said carbonaceous material is at least as much as the pour point temperature of the said material, and removing the fluid along with the liquid carbonaceous material through the fluid withdrawal means in the first passage and through the second passage.

2. The method of claim 1 wherein a substantial portion of the mobilized carbonaceous material is moved in a direction generally opposite to the flow of the injection fluid and its resultant released heat.

3. The method of claim 1 wherein the injection fluid is water.

4. The method of claim 3 including the additional step of incorporating an additive to the injection fluid capable of breaking the film of oil adhering to the surfaces of the host rock underground.

5. The method of claim 3 wherein said underground location contains an oil-water contact boundary and the underground communication passage between the said first passage and the said second passage is established through the underground deposit of carbonaceous material.

6. The method of claim 5 including the step of raising the injection fluid release point to a point adjacent to the oil-water contact boundary underground.

7. The method of claim 1 wherein the underground communication passage between the said first passage and the said second passage is established in an underground formation underlying the underground deposit of carbonaceous material.

8. The method of claim 1 further including the steps of capturing the injection fluid together with the melted carbonaceous material at the surface of the ground, separating the injection fluid from the melted carbonaceous material, saving the melted carbonaceous material apart from the injection fluid, and saving the injection fluid apart from the melted carbonaceous material.

* * * * *